US006719167B2

(12) United States Patent
Chang

(10) Patent No.: US 6,719,167 B2
(45) Date of Patent: Apr. 13, 2004

(54) TICKET ROLL DETECTION ARRANGEMENT FOR A TICKET VENDING MACHINE

(75) Inventor: Hung-Yi Chang, Chilung (TW)

(73) Assignee: International Currency Technologies Corporation, Taipei (TW)

( * ) Notice: Subject to any disclaimer, the term of this patent is extended or adjusted under 35 U.S.C. 154(b) by 92 days.

(21) Appl. No.: 10/226,105

(22) Filed: Aug. 23, 2002

(65) Prior Publication Data

US 2004/0035877 A1 Feb. 26, 2004

(51) Int. Cl.[7] ..... G07F 11/00
(52) U.S. Cl. ..... 221/9; 101/66
(58) Field of Search ..... 221/7, 13, 33, 221/9, 277, 258; 226/168, 174, 188; 101/66

(56) References Cited

U.S. PATENT DOCUMENTS 3,978,958 A * 9/1976 Zandstra ..... 194/244
5,484,215 A * 1/1996 Fillod et al. ..... 400/120.18

* cited by examiner

*Primary Examiner*—Kenneth W. Noland
(74) *Attorney, Agent, or Firm*—Rabin & Berdo, P.C.

(57) ABSTRACT

A ticket roll detection arrangement using a photo-grid wheel for synchronous rotation with the ticket roll supply reel of a ticket vending machine, and a photo transmitter receiver assembly on two sides of the photo-grid wheel to detect the revolving speed of the photo-grid wheel upon delivery of the ticket roll out of the ticket vending machine and to measure the diameter of the rest ticket roll on the ticket roll supply reel subject to the detected revolving speed of the photo-grid wheel.

11 Claims, 7 Drawing Sheets

TICKET ROLL DETECTION ARRANGEMENT FOR A TICKET VENDING MACHINE

BACKGROUND OF THE INVENTION

1. Field of the Invention

The present invention relates to ticket vending machines and, more specifically, to a ticket roll detection arrangement used in a ticket vending machine to detect the amount of the loaded ticket roll.

2. Description of the Related Art

FIG. 8 shows the internal structure of a conventional ticket-venting machine. According to this design, the ticket vending machine comprises a frame structure A. The frame structure A comprises a base frame A1, an upright side frame A2 at one lateral side of the base frame A1, and a reel A21 pivoted to the upright side frame A2 and suspended above the base frame A1 for holding a ticket roll (not shown). This structure of ticket vending machine is not satisfactory in function because of the following drawbacks.

1. The user cannot know the rest amount of the ticket roll during the use of the ticket vending machine. When the ticket roll used up, the user may have to keep clients waiting for a length of time before refurnishing of a new ticket roll.
2. When pulling the lead end of the newly loaded ticket roll out of the ticket outlet A3 of the ticket vending machine, an inertia force is produced to keep the reel A21 rotated for a distance after the user released the hand from the lead end of the ticket roll, thereby causing a part of the ticket roll to be wrinkled or jammed in the ticket vending machine between the reel A21 and the ticket outlet A3.

SUMMARY OF THE INVENTION

The present invention has been accomplished to provide a ticket roll detection arrangement for ticket vending machine, which eliminates the aforesaid drawbacks. It is one object of the present invention to provide a ticket roll detection arrangement for ticket vending machine, which detects the rest amount of the ticket roll automatically. It is another object of the present invention to provide a ticket roll detection arrangement for ticket vending machine, which eliminates the inertia effect of the ticket roll supply reel, preventing a measuring error. To achieve these and other objects and according to one aspect of the present invention, the ticket roll detection arrangement comprises rack mounted on the base frame of the frame structure of a ticket vending machine, the rack having two upright side panels; a reel supported in the upright side panels of the rack for free rotation; a ticket roll mounted on the reel; a photo-grid wheel fixedly provided at one end of the reel for synchronous rotation with the reel, and a photo transmitter receiver assembly installed in the rack of the frame structure on two sides of the photo-grid wheel and adapted to detect the revolving speed of the photo-grid wheel upon delivery of the ticket roll out of the ticket vending machine and to measure the diameter of the rest ticket roll on the reel subject to the detected revolving speed of the photo-grid wheel so as to know the actual rest amount of the ticket roll. According to another aspect of the present invention, two support frames are respectively fastened to the upright side panels of the rack, each support frame having two suspension arms adapted to support the reel in the smoothly arched top bearing notches of the rack and to prohibit the reel from producing an inertia effect.

DETAILED DESCRIPTION OF THE PREFERRED EMBODIMENT

Figure 1:
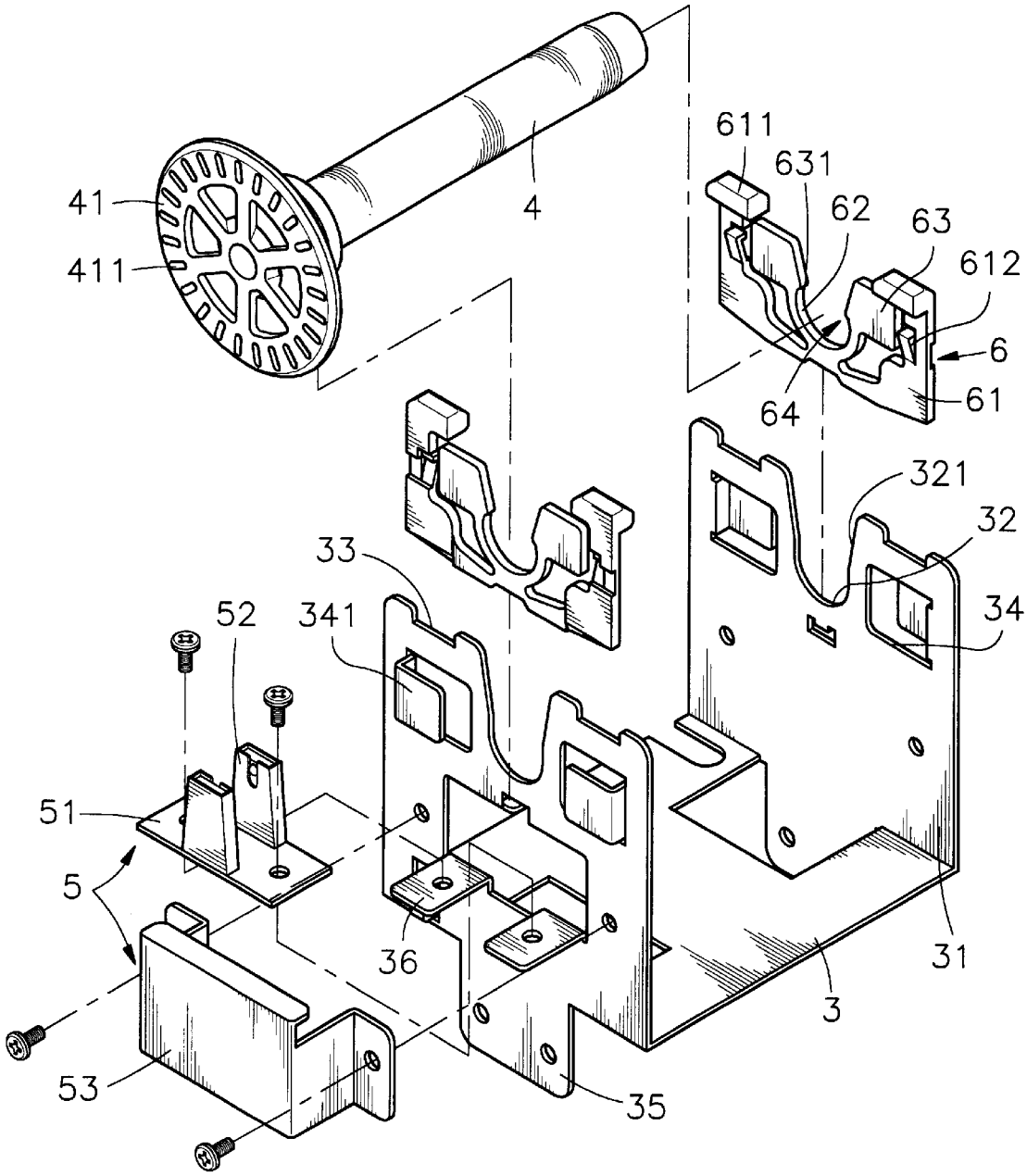
FIG. 1 is an exploded view of a ticket roll detection arrangement for ticket vending machine according to the present invention.
Figure 2:
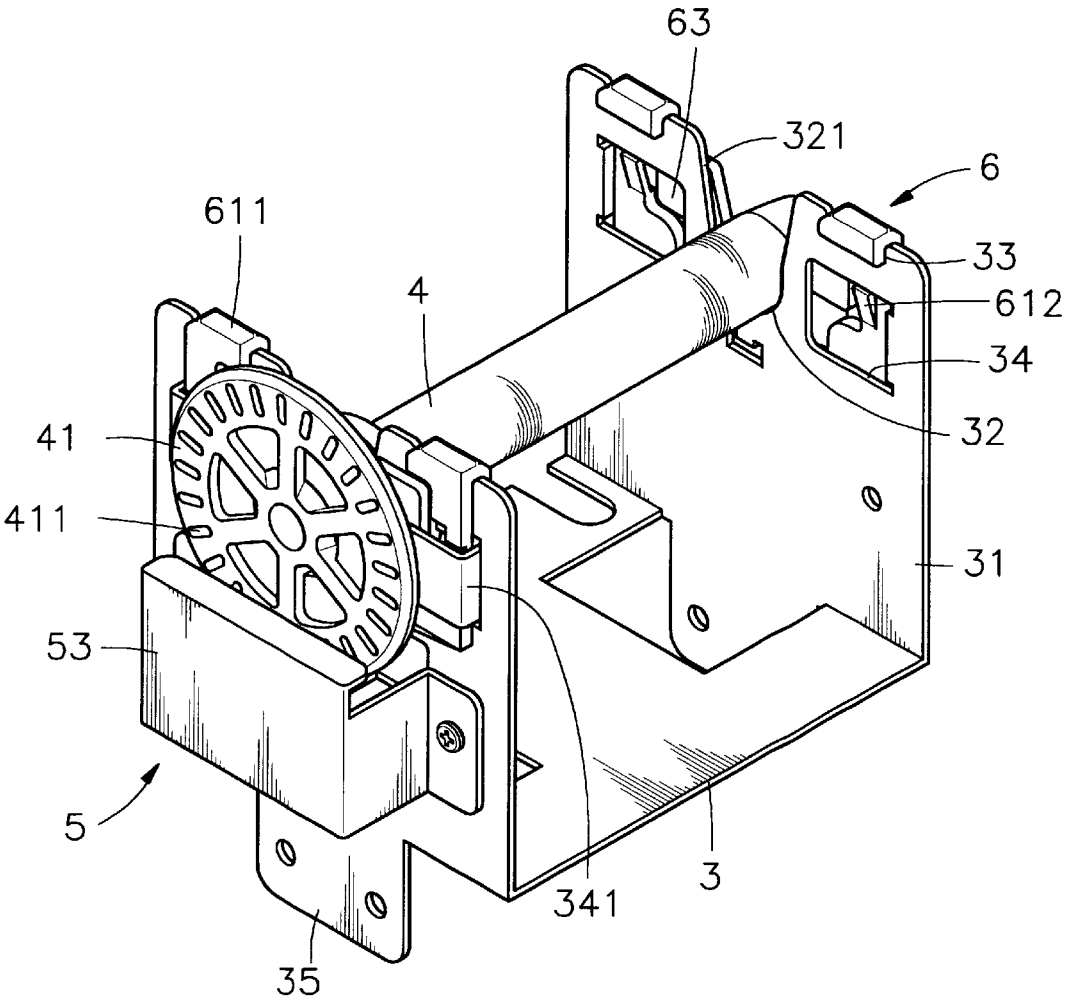
FIG. 2 is an elevational assembly view of the ticket roll detection arrangement according to the present invention.
Figure 3:
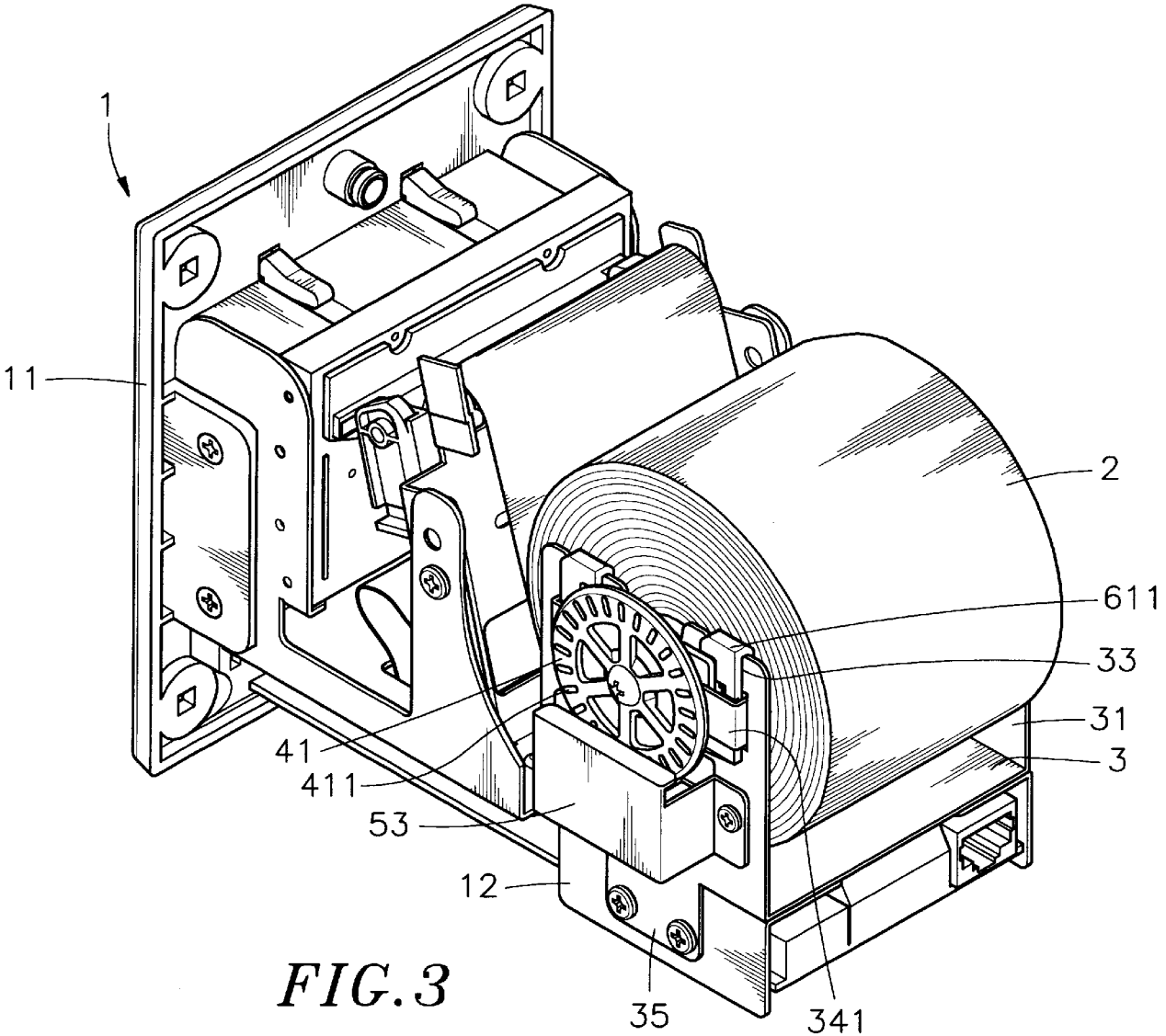
FIG. 3 is an applied view of the present invention, showing the ticket roll detection arrangement installed in the ticket vending machine and a ticket roll mounted in the ticket roll detection arrangement.

Referring to FIGS. from 1 through 3, a ticket roll detection arrangement for ticket vending machine in accordance with the present invention is shown comprised of a frame structure 1, a ticket roll 2, a rack 3, a reel 4, a photo transmitter receiver assembly 5, and two support frames 6.

The frame structure 1 comprises a base frame 12 and a face panel 11 at the front side of the base frame 12 for output of the ticket roll 2.

The rack 3 is mounted on the base frame 12 of the frame structure 1 and spaced from the face panel 11 at a distance, comprising two opposite side panels 31. Each side panel 31 comprises two top locating notches 33 and a smoothly arched top bearing notch 32 between the top locating notches 33, two openings 34 below the top locating notches 33 at two sides of the smoothly arched top bearing notch 32, two angled stop flanges 341 respectively protruded from the periphery of the openings 34 and facing each other, and a downwardly extended bottom mounting flange 35. The smoothly arched top bearing notch 32 of each side panel 31 has a beveled guide edge 321. One side panel 31 further comprises two outwardly extended horizontal mounting flanges 36 suspended above the respective downwardly extended bottom mounting flange 35.

The reel 4 is adapted to hold the ticket roll 2, having a photo-grid wheel 41 at one end. The photo-grid wheel 41 has radial slits 411 equiangularly spaced around the border.

The photo transmitter receiver assembly 5 comprises a circuit board 51, two sensor elements 52 (the sensor elements 52 include a light emitting diode located on one side of the photo-grid wheel 41 for producing light that passes through the slits 411 of the photo-grid wheel 41 for generating encoded signals, and a photo-sensor located on the other side of the photo-grid wheel 41 for receiving the encoded light pulses from the light emitting diode and converting it into electrical signals), and an outer cover 53.

Each support frame 6 comprises a base 61, two suspension arms 62 symmetrically provided on the middle of the base 61 and defining a space 64 therebetween, two guide blocks 63 respectively formed in the free ends of the suspension arms 62, two stop edges 631 respectively formed between the suspension arms 62 and the guide blocks 63, two top retaining blocks 611 bilaterally provided at the top side of the base 61 above the elevation of the guide blocks 63, and two hooks 612 respectively protruded from one side of the base 61. The diameter of the space 64 is smaller than the diameter of the smoothly arched top bearing notch 32.

Figure 4:
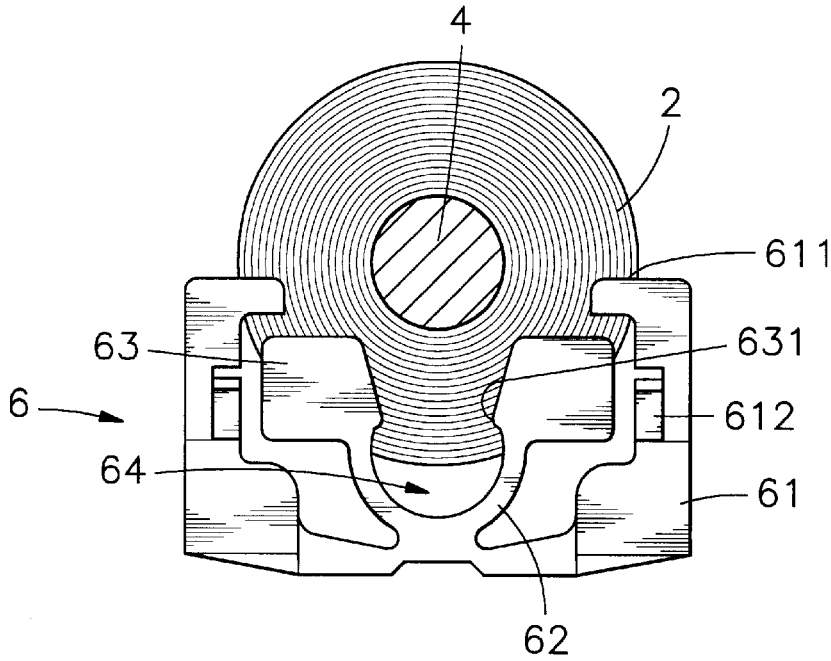
FIG. 4 is a front view of the ticket roll detection arrangement before loading of the ticket roll.
Figure 5:
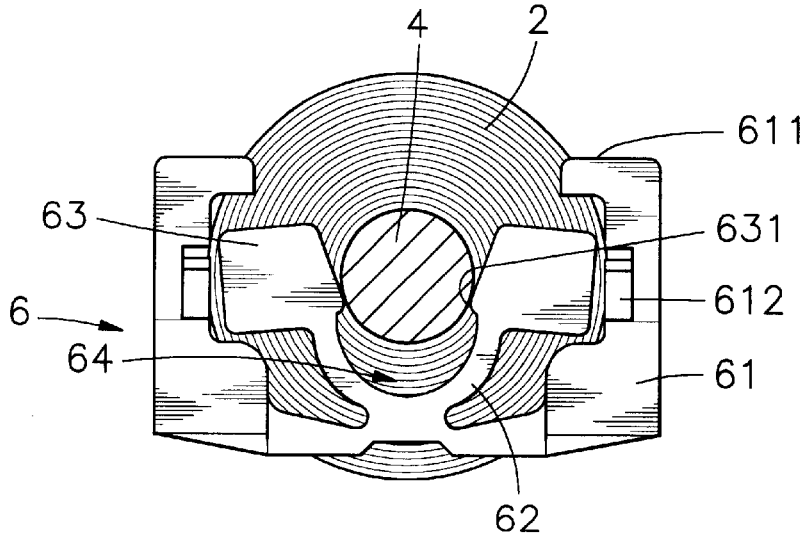
FIG. 5 is a front view of the ticket roll detection arrangement during loading of the ticket roll.
Figure 6:
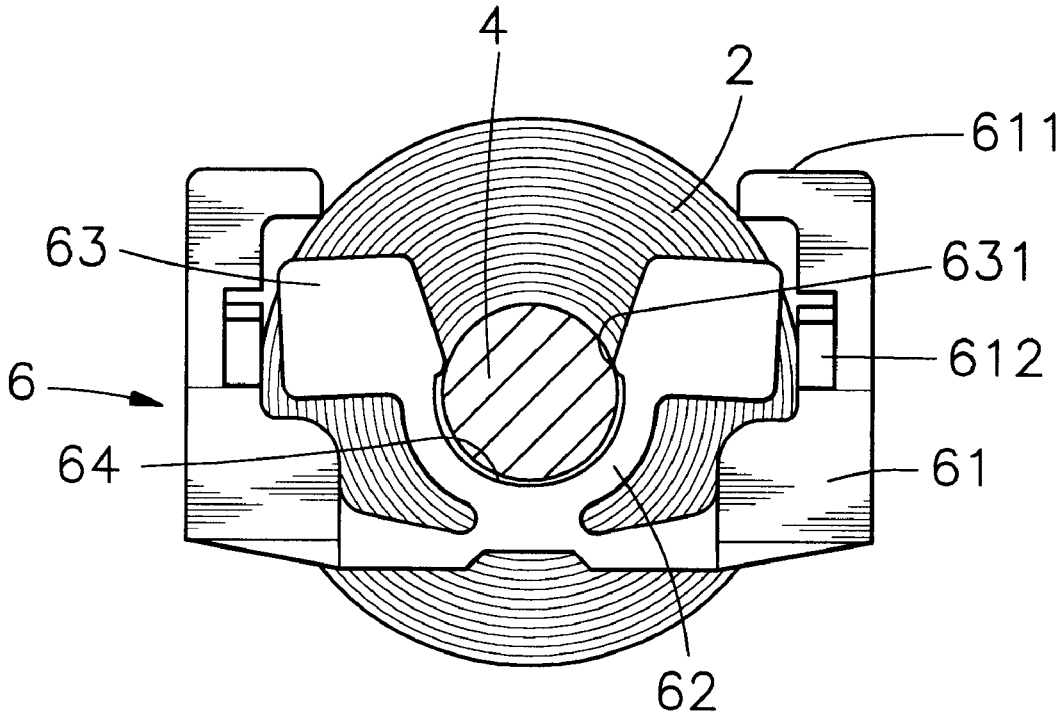
FIG. 6 is a front view of the ticket roll detection arrangement after loading of the ticket roll.
Figure 7:
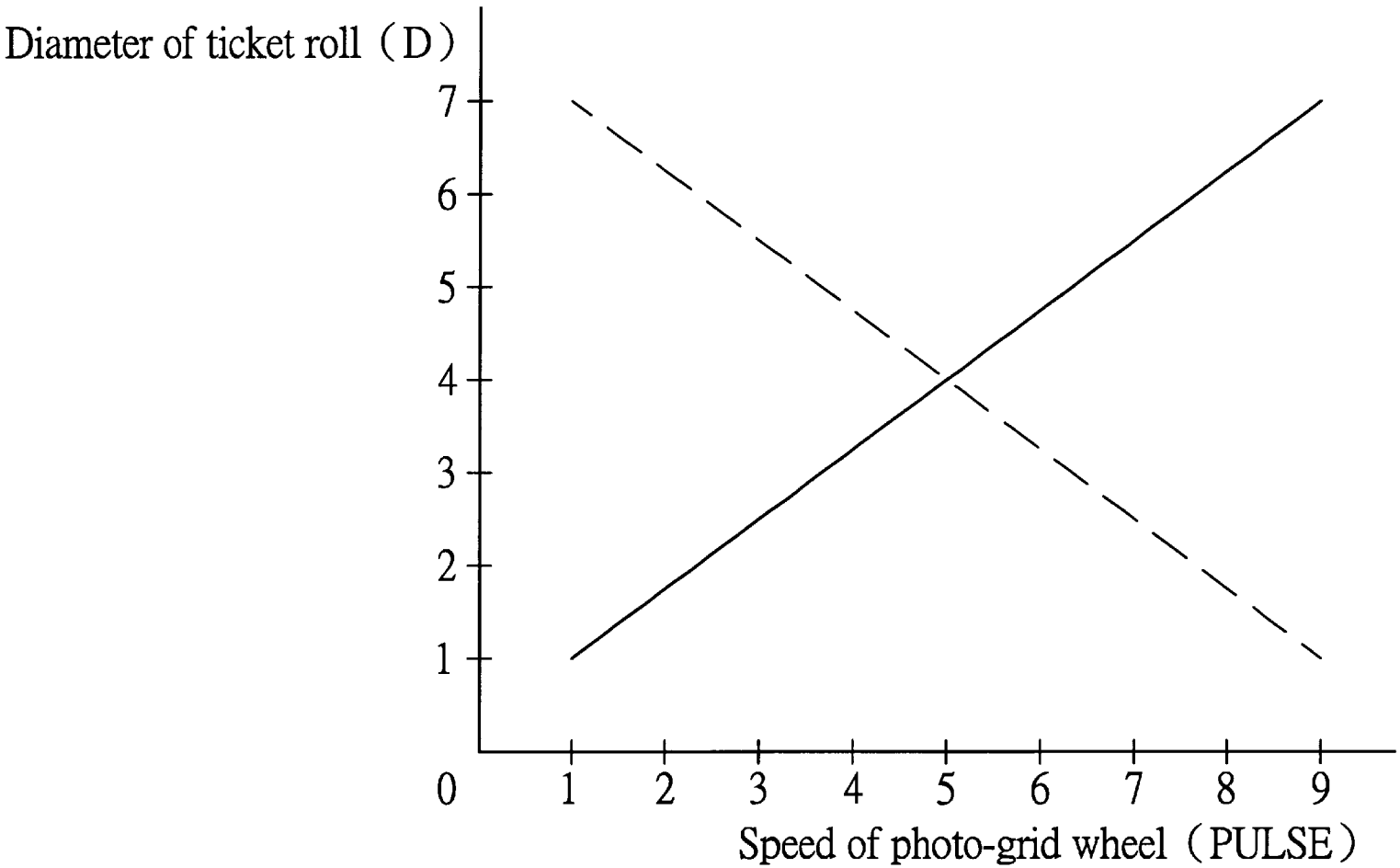
FIG. 7 is a diameter-pulse chart according to the present invention.
Figure 8:
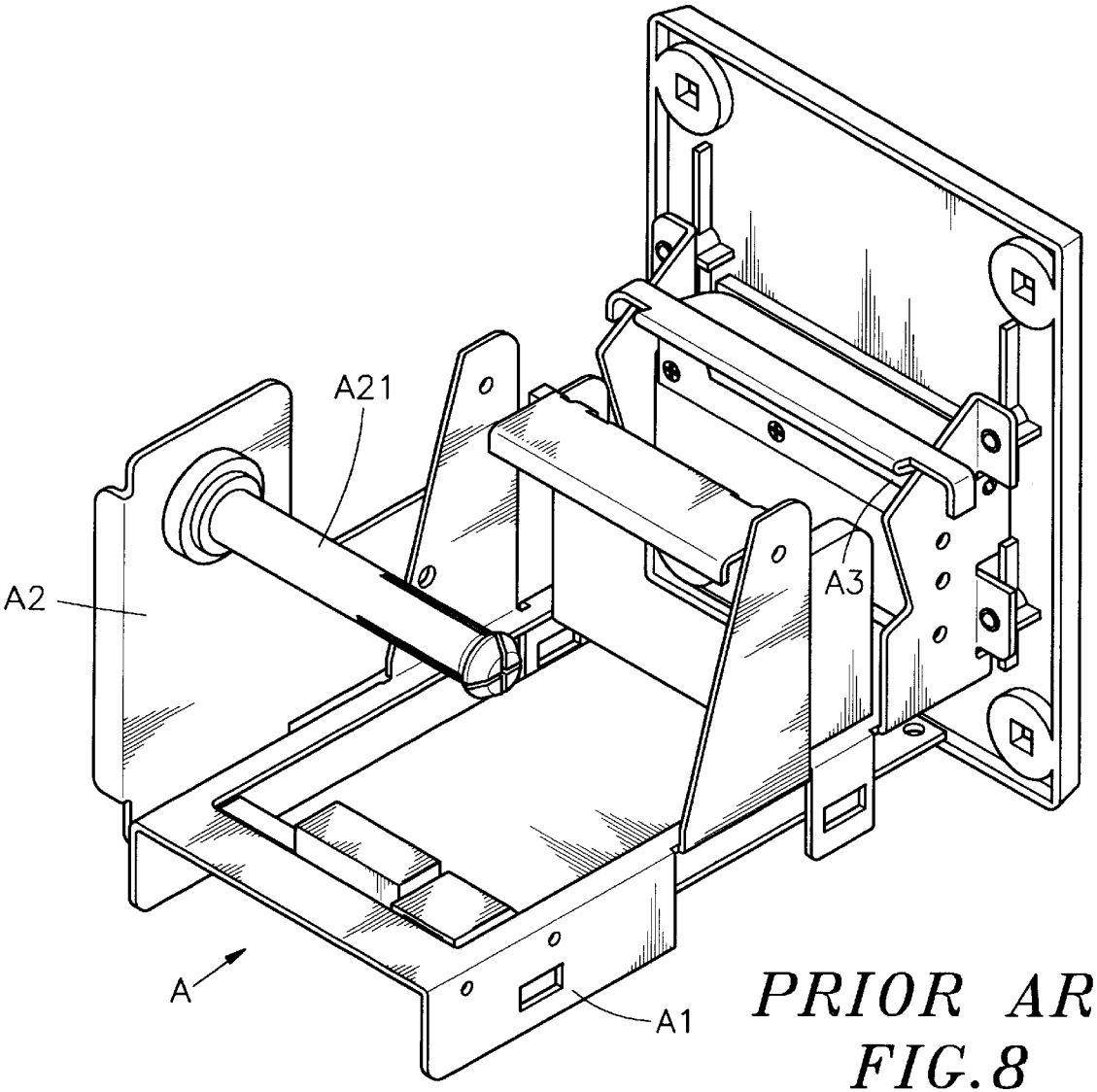
PRIOR ART FIG. 8
FIG. 8 is an elevational view of the frame structure of a ticket vending machine according to the prior art.

Referring to FIGS. 4~6, the support frames 6 are respectively inserted in between the angled stop flanges 341 of each side panel 31 of the rack 3 to force the top retaining blocks 611 and the hooks 612 into engagement with the top locating notches 33 and openings 34 of the side panels 31 of the rack 3 respectively. When loaded, the space 64 of each support frame 6 and the smoothly arched top bearing notch 32 of each side panel 31 of the rack 3 are aligned in a line. Thereafter, the circuit board 51 is fixedly fastened to the outwardly extended horizontal mounting flanges 36 of the rack 3 by screws, and then the outer cover 53 is fixedly fastened to the corresponding side panel 31 of the rack 3 and covered over the circuit board 51 and the sensor elements 52. After installation of the support frames 6 in the rack 3, the reel 4 is mounted with a ticket roll 2 and then forced through the beveled guide edges 321 of the side panels 31 of the rack 3 into spaces 64 between the suspension arms 62 of the support frames 6. When set into position, the stop edges 631 of the support frames 6 are respectively stopped at the periphery of the reel 4 to hold the reel 4 in place, keeping the photo-grid wheel 41 suspended between the sensor elements 52 of the photo transmitter receiver assembly 5. When installed, the reel 4 can be rotated on its own axis in the spaces 64.

Referring to FIG. 7 and FIGS. 1~3 again, as indicated above, the photo-grid wheel 41 has radial slits 411 equiangularly spaced around the border. When the ticket roll 2 pulled out of the face panel 11 of the frame structure 1 to rotate the reel 4, the photo-grid wheel 41 is rotated with the reel 4, the light from one of the sensor elements 52 passed through the radial slits 411 of the photo-grid wheel 41, producing encoded light pulses, and the other of the sensor elements 52 received the encoded light pulses and converted it into electrical signals. When the diameter D of the ticket roll 2 reduced, the amount of the received light pulses within a predetermined length of time is relatively increased. Therefore, the photo transmitter receiver assembly 5 accurately measures the rest amount of the ticket roll 2, enabling the user to refurnish the ticket roll 2 in time.

As indicated above, the ticket roll detection arrangement for ticket vending machine has the advantages as follows:

1. When the ticket roll 2 continuously pulled out of the ticket vending machine, the diameter of the ticket roll 2 is relatively reduced, and the revolving speed of the reel 4 and the photo-grid wheel 41 is relatively increased, therefore the photo transmitter receiver assembly 5 accurately measures the rest amount of the ticket roll 2 subject to the detected revolving speed of the photo-grid wheel 41.
2. The stop edges 631 of the support frames 6 are respectively formed between the suspension arms 62 and the guide blocks 63, to hold the reel 4 in place and to give a damping resistance to the reel 4 during rotary motion of the reel 4, prohibiting the reel 4 from producing an inertia effect.

A prototype of ticket roll detection arrangement for ticket vending machine has been constructed with the features of the annexed drawings of FIGS. 1~7. The ticket roll detection arrangement for ticket vending machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A ticket roll detection arrangement comprising:

a rack mounted on the base frame of the frame structure of a ticket vending machine, said rack having two upright side panels;

a reel supported in the upright side panels of said rack for free rotation; and a ticket roll mounted on said reel;

wherein a photo-grid wheel is fixedly provided at one end of said reel for synchronous rotation with said reel, and a photo transmitter receiver assembly is installed in-said rack of said frame structure on two sides of said photo-grid wheel and adapted to detect the revolving speed of said photo-grid wheel upon delivery of the ticket roll out of the ticket vending machine and to measure the diameter of the rest ticket roll on said reel subject to the detected revolving speed of said photo-grid wheel.

2. The ticket roll detection arrangement as claimed in claim 1, wherein the side panels of said rack each have a downwardly extended bottom mounting flange respectively fastened to the base frame of the ticket vending machine by fastening elements.

3. The ticket roll detection arrangement as claimed in claim 1, wherein the upright side panels of said rack each have a smoothly arched top bearing notch on the middle adapted to support said reel.

4. The ticket roll detection arrangement as claimed in claim 1, wherein one upright side panel of said rack comprises at least one outwardly extended horizontal mounting flange adapted to support said photo transmitter and receiver assembly; said photo transmitter and receiver assembly comprises a circuit board fixedly mounted on the at least one outwardly extended horizontal mounting flange of said rack, a photo transmitter element connected to said circuit board and located on one side of said photo-grid wheel, and a photo receiver element connected to said circuit board and located on an opposite side of said photo-grid wheel.

5. The ticket roll detection arrangement as claimed in claim 4, wherein said photo transmitter receiver assembly further comprises an outer cover fixedly fastened to one upright side panel of said rack by fastening elements around said photo transmitter element and said photo receiver element.

6. The ticket roll detection arrangement as claimed in claim 1, further comprising two support frames respectively fastened to the upright side panels of said rack to support said reel in the smoothly arched top bearing notch of each upright side panel of said rack.

7. The ticket roll detection arrangement as claimed in claim 6, wherein said upright side panels of said rack each comprise two top locating notches on two sides of the respective smoothly arched top bearing notch, two openings on two sides of the respective smoothly arched top bearing notch below the respective top locating notches, and two angled stop flanges respectively protruded from the periphery of said openings and facing each other for the mounting of said support frames.

8. The ticket roll detection arrangement as claimed in claim 7, wherein said support frames each comprise a base, two suspension arms symmetrically provided on said base on the middle and defining a space therebetween for supporting said reel, two guide blocks respectively formed in free ends of said suspension arms, two top retaining blocks bilaterally provided at a top side of said base and respectively engaged into the top locating notches of said upright side panels of said rack, and two hooks respectively protruded from one side of said base and respectively hooked in the openings of said upright side panels of said rack.

9. The ticket roll detection arrangement as claimed in claim 8, wherein said support frames each further comprise two stop edges respectively formed between the respective suspension arms and the respective guide blocks and adapted to engage the periphery of said reel and to hold said reel in said smoothly arched top bearing notches of said upright side panels of said rack and the spaces between the suspension arms of said support frames.

10. The ticket roll detection arrangement as claimed in claim 8, wherein the inner diameter of the openings defined by said suspension arms of said support frame is shorter than the inner diameter of said smoothly arched top bearing notches of said rack.

11. The ticket roll detection arrangement as claimed in claim 1, wherein said photo-grid wheel has a plurality of radial slits equiangularly spaced around the border thereof.

* * * * *